United States Patent [19]

Teramoto et al.

[11] Patent Number: 4,986,541

[45] Date of Patent: Jan. 22, 1991

[54] IRON GOLF CLUB SET

[75] Inventors: Mitsutake Teramoto, Kamakura; Shinkichi Saito, Tokyo; Takaharu Okumoto, Chigasaki; Hideyo Asabuki, Tokyo, all of Japan

[73] Assignee: The Yokohama Rubber Co., Ltd., Tokyo, Japan

[21] Appl. No.: 347,688

[22] Filed: May 5, 1989

[30] Foreign Application Priority Data

May 9, 1988 [JP] Japan ..... 63-60127[U]

[51] Int. Cl.[5] ..... A63B 53/04

[52] U.S. Cl. ..... 273/77 A; 273/77 R; 273/167 R; 273/167 G; 273/167 J

[58] Field of Search ..... 273/77 R, 77 A, 167 G, 273/167 R, 167 J

[56] References Cited

U.S. PATENT DOCUMENTS 4,645,207 2/1987 Teramoto et al. ..... 273/77 A
4,754,969 7/1988 Kobayashi ..... 273/77 A
4,854,580 8/1989 Kobayashi ..... 273/77 A

FOREIGN PATENT DOCUMENTS 2109249 6/1983 United Kingdom ..... 273/77 R
2170719 8/1986 United Kingdom ..... 273/77 A
2194737 3/1988 United Kingdom ..... 273/77 A

*Primary Examiner*—Edward M. Coven
*Assistant Examiner*—Raleigh W. Chiu
*Attorney, Agent, or Firm*—Finnegan, Henderson, Farabow, Garrett & Dunner

[57] ABSTRACT

Iron golf club set which comprises a plurality of iron clubs having different loft angle between the face of the head and the axis of the shaft of the club. All or some of the clubs in the set have face progression values, which are a distance between the bottom leading edge of the face of the head and the axis of the shaft, which are reduced consecutively or in steps in accordance with a decrease in the value of the loft angle, i.e., a decrease in the club number.

3 Claims, 3 Drawing Sheets

IRON GOLF CLUB SET

BACKGROUND OF THE INVENTION

1. Field of the Invention

The present invention relates to golf clubs, and more particularly, to an improved set of iron golf clubs which comprises long iron clubs having a small loft angle value by which achieving a timely impact of the club with the ball is made easier for an unskilled player.

2. Description of the Related Art

A set of iron golf clubs usually includes a plurality of iron clubs numbered from 1 to 9, plus a pitching wedge, and each of the iron clubs has a shaft and a head defining a face inclined rearwardly to the vertical axis of the shaft in the direction of movement of the head of the club when swung. The value of an angle of the face with respect to the vertical axis, i.e., the loft angle, is increased with each increase in the number of the club, and accordingly, the pitching wedge has the largest loft angle value. All of the iron clubs in one golf club set usually have the same club face progression value of, for example, 1 mm to 3 mm. The term face progression refers to the distance between the central axis of a shaft and a bottom leading edge of the face of the club. It should be noted that the face progression value is a factor in determining the loft of the ball, although the influence of the face progression value on the loft of the ball is not as great as that of the loft angle of the face. It should be further noted that the higher the loft of the ball, the shorter the run of the ball after subsequent contact with the ground, which is advantageous in view of making it easy for a player to place the ball at a desired position, and this is a very important characteristic of high number clubs.

Nevertheless, as is well known, when the face progression value is large, it is difficult for an unskilled player to achieve a timely impact of the club with the ball when using iron clubs having a low number, i.e., long iron clubs, which have a small loft angle value. Conversely, when the number of the club is high, i.e., the club is a short iron with a large loft angle value, the average unskilled player has no great difficulty in achieving such a timely impact of the club with the ball.

SUMMARY OF THE INVENTION

An object of the present invention is to provide a golf club set which enables an unskilled player to easily hit a ball when using long iron clubs with a small loft angle, while obtaining as large a face progression value as possible for short iron clubs.

According to the present invention, an iron golf club set is provided which comprises a plurality of numbered iron clubs, each club in the set having a shaft and a head having a face which is inclined rearwardly with respect to the axis of the shaft in the direction of the movement of the head of the club when swung, and defining a bottom edge, the value of the angle of the face with respect to the axis of the shaft being increased in accordance with the increase in the number of the golf club and each club defining a face progression which is a distance between the center of the shaft of the club and the bottom leading edge of the face, the clubs in the set having a plurality of face progression values wherein the face progression value becomes smaller as the value of the loft angle is further decreased.

In one embodiment of the present invention, all of or some of the clubs in a set have a face progression value which is reduced consecutively in accordance with a decrease in the loft angle, i.e., the face progression value is reduced with each decrease in the number of the golf club. In this case, the rate of reduction in the face progression value is preferably between 0.1 mm to 0.3 mm for each decrease in the number of the golf club.

In another embodiment of the present invention, all of or some of the clubs in a set have a face progression value which is reduced in steps in accordance with the decrease in the loft angle value, i.e., the face progression value is reduced for every stepped decrease in the number of the golf club. In this case, the reduction of the face progression value is realized by steps of between 0.2 mm to 1.0 mm.

According to the present invention, the face progression value of all or some of the clubs in the set, including No. 1 to No. 9 plus the pitching wedge, is reduced consecutively or in steps in accordance with the decrease in the number of the club, i.e., the loft angle, thus making it easy for an unskilled player to achieve a timely impact of the club with the ball when using a long iron club to obtain a long drive, whereby an unskilled player is encouraged to use a long iron club without hesitation.

BRIEF DESCRIPTION OF THE DRAWINGS

FIG. 3(*b*) shows a loft of the ball when hit by a club having an intermediate face progression value;

FIG. 3(*c*) shows a loft of the ball when hit by a club having a small face progression value;

DESCRIPTION OF THE PREFERRED EMBODIMENTS

Figure 1:
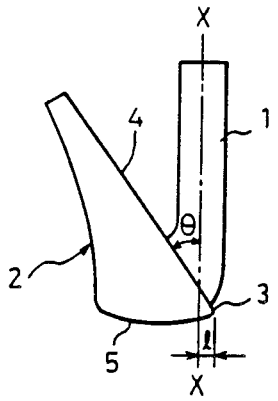
FIG. 1 is an overall side view of an iron golf club.
Figure 2:
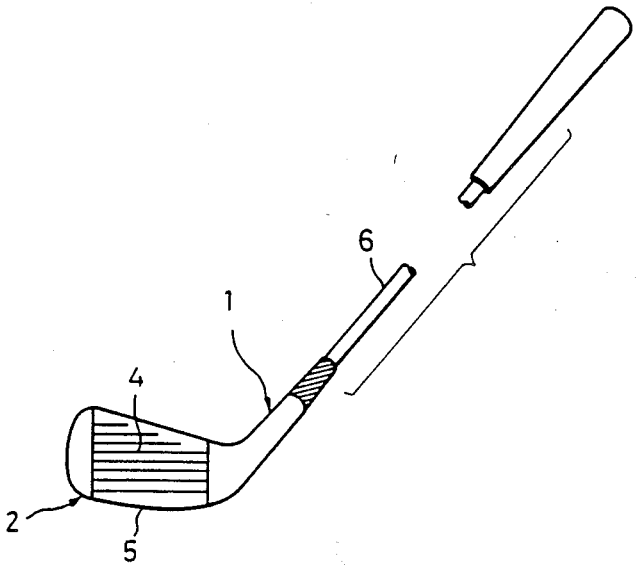
FIG. 2 is a front view of a head of the iron club shown in FIG. 1.

FIGS. 1 and 2 show an iron golf club in an iron golf club set according to the present invention. The iron golf club 1 has a shaft 6, a head 2, and a hosel 1, which is an integral part of the head, for connecting the head 2 to the shaft 6. The head 2 defines a face 4 as a substantially flat plane which is inclined rearwardly with respect to the vertical axis X—X, and defines a bottom leading edge 3 and a sole 5 extending rearwardly from the bottom leading edge 3 of the face 4.

The hosel 1 has a central axis X—X which coincides with the center axis of the shaft 6. The face 4 forms a plane which extends in a direction such that an angle $\theta$ is formed with respect to the axis X—X, i.e., the loft angle. As is well known, as the number of the club increases, the loft angle is correspondingly enlarged. A distance is formed between the central axis X—X and the bottom leading edge of the face, and this distance 1 is known as the face progression.

Figure 3A:
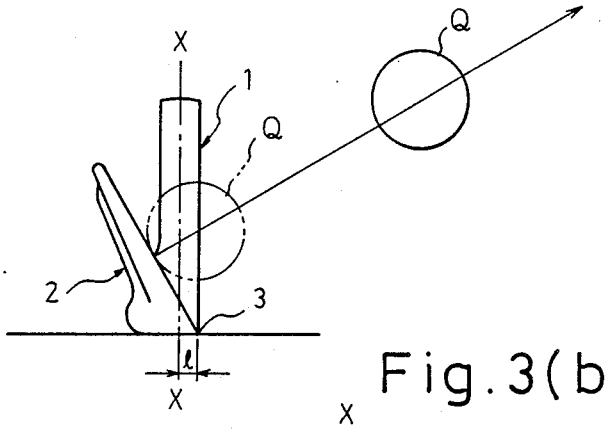
FIG. 3(*a*) shows a loft of the ball when hit by a club having a large face progression value.
Figure 3B:
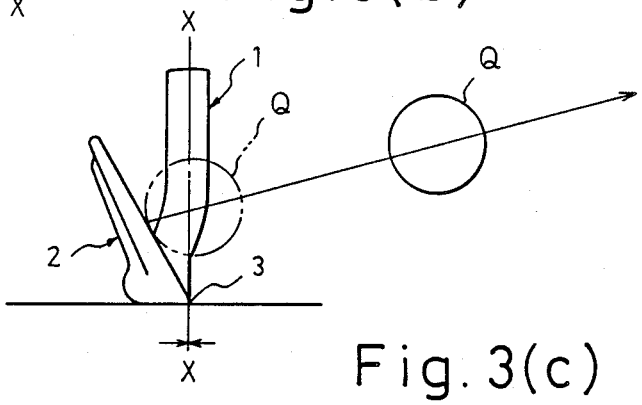
Figure 3C:
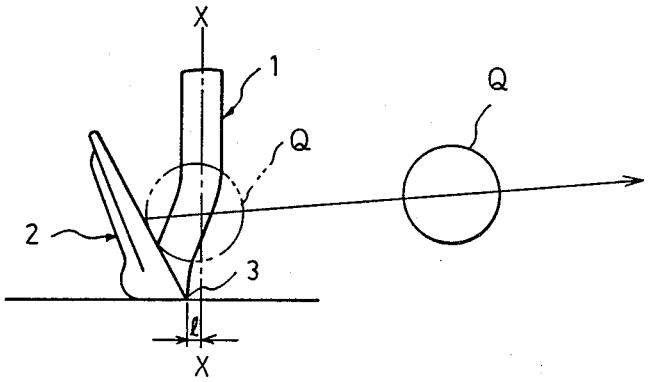

The value of the face progression (F.P.) has an affect on the loft (trajectory) of a ball. For example, an arrangement wherein the bottom leading edge 3 of the face 4 is located forward of the central axis X—X, as shown in FIG. 3(*a*), in the direction of the movement of the head when the club is swung, herein referred to as a face progression plus value, will increase the height of the loft of the ball Q, but an arrangement wherein the bottom leading edge 3 of the face 4 is located on the central axis X—X, as shown in FIG. 3(*b*), herein referred to as a face progression zero value, will give a medium loft of the ball Q. Furthermore, an arrangement wherein the bottom leading edge 3 of the face 4 is located rearward of the central axis X—X, as shown in FIG. 3(*c*), in the direction of the movement of the head when the club is swung, herein referred to as a face progression minus value will give a low loft of the ball Q.

It is very well known that it is more difficult for an inexperienced player to correctly position the ball when using long iron clubs having small loft angles than when using short iron clubs having a large loft angle. Further, it is known that the smaller the face progression value, the easier it is for an unskilled player to achieve a timely impact of the club head with the ball.

It should be noted that the same face progression value is conventionally employed for all clubs in a golf club set. In this respect, although a large face progression value is advantageous from the point of view of obtaining a relatively high loft of the ball, a large face progression value makes it difficult for an unskilled player to correctly hit a ball when the loft angle of the club is small, i.e., a low number long iron club is used.

In Examples 1 to 3 of the present invention, some or all of the iron golf clubs No. 1 to No. 9 and the pitching wedge in one golf club set have face progression values (F.P.) which are consecutively reduced in accordance with each decrease in the loft angle of the clubs, i.e., for each decrease in the golf club number, and the value of each decrease in the face progression value is between 0.1 mm to 0.3 mm.

Figure 4:
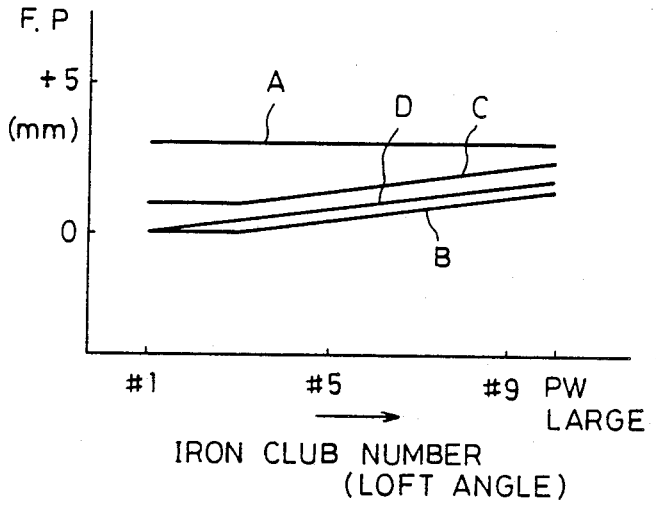
FIG. 4 shows the relationships between the number of an iron club and the face progression value according to first, second, and third embodiments of an iron club set of the present invention, in comparison with a prior art golf club set in which all clubs have the same face progression value; and, FIG. 5 shows the relationships between the number of the iron club and the face progression value according to fourth, fifth, and sixth embodiments of an iron club set of the present invention, in comparison with a prior art golf club set in which all of the clubs have the same face progression value.

Examples 1 to 3 will be described with reference to Table I, which shows the face progression values (F.P.) thereof in millimeters, and FIG. 4 which shows the relationship between the golf club number and the face progression values.

TABLE I

| FP value | Club No. | | | | | | | | | |
|---|---|---|---|---|---|---|---|---|---|---|
| (mm) | #1 | #2 | #3 | #4 | #5 | #6 | #7 | #8 | #9 | P.W |
| Example 1 | 0 | 0 | 0 | 0.2 | 0.4 | 0.6 | 0.8 | 1.0 | 1.2 | 1.4 |
| Example 2 | 1.0 | 1.0 | 1.0 | 1.2 | 1.4 | 1.6 | 1.8 | 2.0 | 2.2 | 2.4 |
| Example 3 | 0 | 0.2 | 0.4 | 0.6 | 0.8 | 1.0 | 1.2 | 1.4 | 1.6 | 1.8 |

In Example 1, the face progression values are reduced in the clubs from the P.W. to No. 3 in such a manner that the face progression values are reduced from the value of 1.4 mm for the P.W. the value of 0.2 mm for club No. 4, in such a manner that the face progression values are reduced by a value of 0.2 mm in accordance with each decrease in the loft angle, i.e., the club number. In club numbers 1, 2, and 3, the face progression values are fixed at the lowest value, i.e., zero. In Example 2, the face progression values are reduced from the value of 2.4 mm for the P.W. to the value of 1.0 for club No. 3, in such a manner that the face progression values are reduced by a value of 0.2 mm in accordance with each decrease the loft angle, i.e., the club number. In club numbers 1, 2 and 3, the face progression values are fixed at the lowest value, i.e., 1.0 mm. In Example 3, the face progression values are reduced from the value of 1.8 mm for the P.W. for all of clubs down to No. 1, in such a manner that the face progression values are reduced by a value of 0.2 in accordance with each decrease in the loft angle, i.e., the club number.

It should be noted that, in the above Table I, the face progression pitch value in accordance with the decrease in the club number is from 0.1 mm to 0.3 mm, preferably 0.2 mm. The relationships between the face progression values and the club number in Examples 1, 2, and 3 are shown by curves B, C and D respectively in FIG. 4, in comparison with that of the prior art shown by a curve A, where all of the clubs have the same face progression value.

In Examples 4 to 6 of the present invention, some or all of the iron golf clubs No. 1 to No. 9 and the pitching wedge in one golf club set have face progression (F.P.) values which are reduced in steps in accordance with the decrease in the loft angle of the clubs, i.e., each decrease in the number of the clubs, and the value of each step reduction in the face progression value is between 0.2 mm to 1.0 mm.

Figure 5:
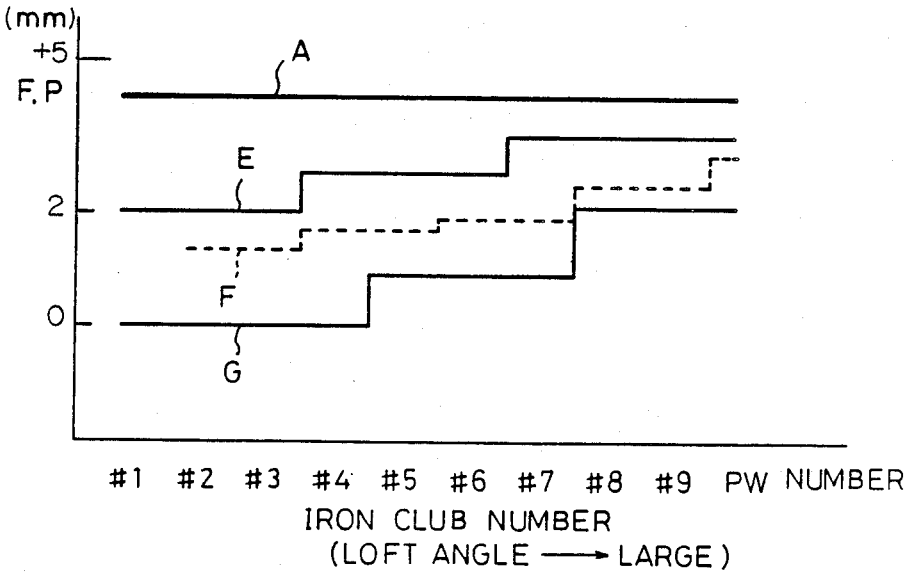

Examples 4 to 6 will be described with reference to Table II, which shows the face progression (F.P.) values in Examples 4 to 6, and FIG. 5 which shows the relationships between the golf club number and the face progression values.

TABLE II

| FP value | Club No. | | | | | | | | | |
|---|---|---|---|---|---|---|---|---|---|---|
| (mm) | #1 | #2 | #3 | #4 | #5 | #6 | #7 | #8 | #9 | P.W |
| Example 4 | 2.0 | 2.0 | 2.0 | 2.3 | 2.3 | 2.3 | 2.6 | 2.6 | 2.6 | 2.6 |
| Example 5 | — | 1.5 | 1.5 | 1.7 | 1.7 | 1.9 | 1.9 | 2.3 | 2.3 | 2.5 |
| Example 6 | 0 | 0 | 0 | 0 | 1.0 | 1.0 | 1.0 | 2.0 | 2.0 | 2.0 |

In Example 4 (line E in FIG. 5), the face progression values are reduced from the value of 2.6 for the pitching wedge at a pitch of 0.3 mm in accordance with each decrease of every three club numbers. In club numbers 1, 2 and 3, the face progression values are fixed at the lowest value, i.e., 2.0. In Example 5 (line F in FIG. 5), the pitching wedge has the face progression value of 2.5, and between club No. 9 to No. 2, the face progression values are reduced from the value of 2.3 of No. 9 by a value of 0.2 or 0.4 mm in accordance with each decrease in every two club numbers. In Example 6 (line G in FIG. 5), the face progression values are reduced from the value of 2.0 for the pitching wedge by a value of 1.0 in accordance with each decrease of every three club numbers.

It should be noted that, in the above table II, the face progression pitch value in accordance with every step in the club number is from 0.2 mm to 1.0 mm. The relationships between the face progression values and the club numbers for Examples 4, 5, and 6 are shown by curves E, F and G respectively in FIG. 5, in comparison with that of the prior art shown by a curve A, where all of the clubs have the same face progression value.

Although the present invention is described with reference to the attached drawings, many modifications and changes can be made by those skilled in this art without departing from the scope of this invention.

We claim:

1. A set of iron golf clubs which comprises a plurality of progressively numbered iron clubs, each of said clubs having a shaft and a head having a face which is inclined rearwardly with respect to the vertical axis of the shaft in the direction of the movement of the head when the club is swung and having a bottom leading edge, the angle of the face with respect to the vertical axis increasing with an increase in the progressive numbering of said plurality of golf clubs, each of said clubs having a face progression value, which is the distance between the vertical axis of the shaft of the club and the bottom leading edge of the face, said plurality of golf clubs in the set being divided into a plurality of groups according to their lengths with each of the groups containing progressively numbered golf clubs, wherein all of the golf clubs in anyone group have the same face progression value while the value of the face progression between the groups increases in the groups as the golf club numbers increase.

2. The set of iron golf clubs in claim 1, wherein the number of said groups is three, whereby the golf clubs in the set are divided into low, medium, and high number golf clubs, the face progression value of the clubs in each of the groups being the same while the value of the face progression of each of the groups increases, in order from the low to the high number club group.

3. The set of iron golf clubs of claim 2, wherein the increase of the face progression value between groups is from 0.2 mm to 1.0 mm.

* * * * *

UNITED STATES PATENT AND TRADEMARK OFFICE

CERTIFICATE OF CORRECTION

PATENT NO. : 4,986,541

DATED : January 22, 1991

INVENTOR(S) : Mitsutake Teramoto et al.

It is certified that error appears in the above-identified patent and that said Letters Patent is hereby corrected as shown below:

Column 6, Claim 1, line 3, delete "in the groups"; and line 4, after "numbers" insert --in the groups--.

Signed and Sealed this

Eighteenth Day of August, 1992

*Attest:*

DOUGLAS B. COMER

*Attesting Officer*

*Acting Commissioner of Patents and Trademarks*